United States Patent [19]

Takahashi et al.

[11] 4,427,762

[45] Jan. 24, 1984

[54] METHOD OF FORMING AN IMAGE WITH A PHOTOGRAPHIC CUPROUS HALIDE MATERIAL

[75] Inventors: Toshiaki Takahashi, Musashimurayama; Noboru Itoh, Hino, both of Japan

[73] Assignee: Konishiroku Photo Industry Co., Ltd., Japan

[21] Appl. No.: 450,047

[22] Filed: Dec. 15, 1982

[30] Foreign Application Priority Data

Dec. 16, 1981 [JP] Japan ..... 56-203177
Dec. 16, 1981 [JP] Japan ..... 56-203178
Dec. 16, 1981 [JP] Japan ..... 56-203179

[51] Int. Cl.[3] ..... G03C 5/30

[52] U.S. Cl. ..... 430/436; 430/437; 430/413; 430/417; 430/478

[58] Field of Search ..... 430/436, 437, 478, 413, 430/417, 569, 495

[56] References Cited

U.S. PATENT DOCUMENTS 3,996,053 12/1976 Martin ..... 430/417
4,350,758 9/1982 Koitabashi et al. ..... 430/569

OTHER PUBLICATIONS

Research Disclosure, Nov. 1976, 15166, pp. 87–88.

*Primary Examiner*—Mary F. Downey
*Attorney, Agent, or Firm*—Finnegan, Henderson, Farabow, Garrett & Dunner

[57] ABSTRACT

An image-forming method wherein a photosensitive material comprising a support having a photosensitive copper (I) halide emulsion that contains silver halide and which has grains of copper (I) halide crystal dispersed in a binder is subjected to imagewise exposure and development with an alkaline solution is disclosed. The imagewise exposure is effected either in a dry or wet state. The alkaline solution contains compounds selected from at least two of the following three groups: (A) a group consisting of α-amino acids, α-amino acid derivatives, aliphatic carboxylic acids, oxycarboxylic acids, ketocarboxylic acids, aromatic carboxylic acids, amines, amine derivatives, aminocarboxylic acids, quinoline derivatives and pyridine derivatives, which compounds have a stability constant for Cu(II) complex between 5 and 15; (B) a group consisting of 4-aminophenols and 3-pyrazolidones; and (C) a group consisting of ascorbic acid derivatives of the following formula (I) and alkali metal salts thereof:

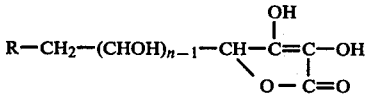

(I)

wherein R is a hydrogen atom or a hydroxyl group; n is a positive integer of from 1 to 4, and when n=1, R represents only a hydroxyl group. The result is an image of improved quality that has a high maximum color density, low fog density, high contrast and a neutral tone.

12 Claims, No Drawings

METHOD OF FORMING AN IMAGE WITH A PHOTOGRAPHIC CUPROUS HALIDE MATERIAL

FIELD OF THE INVENTION

The present invention relates to a method of forming an image with a cuprous halide or copper (I) halide emulsion, and more particularly, to a method of forming such emulsion.

BACKGROUND OF THE INVENTION

Silver halide photography and silver halide diffusion transfer process are conventionally known as methods of high-sensitivity photography. Details of the former method are described in J. H. James, "The Theory of the Photographic Process", Macmillan, New York 1966, and those of the latter method are described in A. Rott and E. Weyde, "Photographic Silver Halide Diffusion Processes", The Focal Press, London and New York, 1972.

A photographic material having fairly high sensitivity is sold by Minnesota Mining & Manufacturing Company under the trade name "Dry-Silver" and details of this product are given in U.S. Pat. Nos. 3,152,903, 3,152,904 and 3,457,075.

These photographic techniques are characterized by high-sensitivity and rapid or dry processing to produce a high-quality image in their own way. But most of them require the use of much silver since silver halide is used as a photosensitive material and metallic silver is used as an image-forming material (or as an intermediate medium for dye-image formation in case of silver halide salt color photography). On the other hand, only part of the spent silver (i.e. silver used in image formation and lost in the processing solutions) is recovered for further use, and this is the primary reason why silver halide photography is expensive. Depletion of silver resources and fluctuations in silver price are two more reasons for making the silver salt photography unsuitable for use in today's energy-sensitive industry. Therefore, the development of a photographic process using a limited amount of silver or eliminating its use entirely is desired.

While many nonsilver photographic processes have been reported, most of them are of lower sensitivity than silver halide photography, and most of the nonsilver photographic materials are not capable of forming an image of continuous tone. Among the nonsilver photographic materials, those which use the grains of copper (I) halide crystal have a relatively high sensitivity and produce an image of continuous tone, and photographic methods that use these photosensitive materials are described in Research Disclosure Nos. 15166 and 15252. According to these references, the crystal of copper (I) halide is sensitive to ultraviolet rays and a photosensitive material prepared by coating a support with a dispersion of the grains of the crystal in a binder solution can produce a colored image of continuous tone by irradiation with UV rays and physical development. Harry T. Spencer and Jacqueline E. Hill studied a method of developing this photosensitive material and details of their study are given in Research Disclosure No. 15166 (1976). First, the crystal of copper (I) halide is dispersed in a solution of a binder such as cellulose acetate butyrate which is soluble in an organic solvent (e.g. acetone or acetonitrile) and the resulting dispersion is spread on a support and dried to prepare a copper (I) halide photosensitive material. It is exposed in a wet state as it is immersed in a polar solvent such as water, alcohols (e.g. methanol and ethanol) and glycols (e.g. ethylene glycol and diethylene glycol) or an alkaline developer wherein these solvents are mixed with alkylamines such as ethylenediamine, diethylene triamine and triethylenetetramine. Then, a disproportionating reaction takes place according to the following scheme (1) and metallic copper and a $Cu^{2+}$ ion are formed: $2Cu^{+} \rightarrow Cu^{\circ} + Cu^{2+}$ (1). When the photosensitive material having metallic copper is developed with a solution containing alkylamine (with triethylenetetramine being particularly preferred), the alkylamine forms a complex with the $Cu^{2+}$ ion. Since the metallic copper acts as a catalyst in disproportionation, the reaction proceeds rapidly in an area where metallic copper has been produced by exposure. This way, the photosensitive material is developed to provide a visible image.

The inventors of the present invention prepared an emulsion comprising fine grains of a copper (1) halide-containing silver halide crystal by mixing an aqueous solution containing $Cu^{2+}$ ions and another aqueous solution containing a halogen ion and a reducing agent to reduce the $Cu^{2+}$ ions in an aqueous gelatin solution in the presence of $Ag^{+}$ ion. As stated in Japanese Patent Application No. 24669/81, a photosensitive material having this emulsion applied onto a support has sensitivity in a dry state. The inventors exposed this sensitive materil and tried to develop it with a mixture of 4-N-methylaminophenol hemisulfate or 1-phenyl-3-pyrazolidone and hydroquinone in a pH range of from 6 to 14, but no visible image could be formed at any of the pHs in that range. A visible image could be obtained when the photosensitive material was developed in an alkaline aqueous solution of alkylamine such as ethylenediamine or triethyleneamine by making use of the disproportionating reaction described above. However, development in an aqueous alkaline aolution of alkylamine of a photosensitive material prepared by coating a support with a copper (I) halide emulsion or the same emulsion containing silver halide has the following disadvantages: (1) the colored image formed by development has high fog density (color density of the unexposed area), (2) the image has low maximum color density, and (3) the image has low contrast.

Japanese Patent Application (OPI) No. 96531/77 (the symbol OPI as used herein means an unexamined published Japanese patent application) discloses a technique for producing a black nonsilver image from a copper compound. According to this technique, a photosensitive material comprising a support coated successively with a layer that contains a salt of monovalent or divalent copper or its complex and a hydrophilic binder and an emulsion layer containing a small amount of silver halide is exposed and developed to form an imagewise pattern of metallic silver (developed silver), and a small amount of this metallic silver is used as a direct catalyst for chemical development of the photosensitive material with a developer containing a reducing agent such as paraformaldehyde, formalin, amineboranes, sodium borohydride, L-ascorbic acid, pyrazolidones, aminophenols and polyhydroxybenzenes. But when the present inventors subjected this photosensitive material to imagewise exposure in a dry state or a wet state as it was immersed in a developer, and subsequently developed it with a solution containing L-ascorbic acid and diethanolamine or dimethylamineborane and triethanolamine, the following disadvantages resulted: (I) the colored image produced by the development had high fog density and/or the image had a low maximum color density, and (2) the image had low contrast.

The present inventors then made studies on various developers suitable for the copper (I) halide photosensitive material, and found that by developing it with an alkaline aqueous solution of an amino acid typified by L-glutamine or an amino acid derivative, a colored image having less fog than that obtained by development with an aqueous alkylamine solution (e.g. aqueous triethylenetetramine solution) or a solution containing dimethylamineborane and triethanolamine could be obtained, but the maximum color density and image contrast were not satisfactorily high.

The inventors therefore continued their search for improved developers by studying the mechanism of development of the copper (I) halide photosensitive material, as well as the defects of the conventional developers. As a result, they found that when a photosensitive copper (I) halide material containing no silver halide was immersed in a weakly alkaline aqueous solution of 4-N-methylaminophenol sulfate, then exposed in a wet state and developed with said solution, a photographic image that had low maximum color density and low contrast but which had no fog was produced. When the same photosensitive material was likewise processed with a weakly alkaline aqueous solution of L-ascorbic acid, a similar photographic image (low maximum density and contrast but having no fog) was obtained. It was found that by developing the copper (1) halide photosensitive material with the developer comprising an alkaline aqueous solution of an amino acid typified by L-glutamine or an amino acid derivative or an alkaline aqueous solution of an amine or an amine derivative, a colored image having less fog (e.g. color density at the unexposed area) but having a high maximum color density and a relatively high image contrast could be obtained, but the meximum color density and image contrast were not satisfactorily high. However, when the same processing was conducted with an alkaline aqueous solution containing both 4-N-methylaminophenol sulfate and L-ascorbic acid, or both L-ascorbic acid and α-amino acid, or both 4-N-methylaminophenol sulfate and α-amino acid, the developer had superadditivity and produced a photographic image of good quality that had a high maximum color density, a very low fog density, high contrast and a neutral tone. This is very surprising since no other developer composition has ever been known to exhibit such superadditivity in the development of the photosensitive copper (I) halide material.

SUMMARY OF THE INVENTION

One object of the present invention is to provide a developer having superadditivity in the development of a photosensitive copper (I) halide material.

Another object of the invention is to provide a developer that can be used in developing the copper (I) halide photosensitive material to produce an image having high maximum color density and low fog density.

Still another object of the invention is to provide a developer that can be used in developing the copper (I) halide photosensitive material to produce a high-contrast image.

A further object of the invention is to provide a deceloper that can be used in developing the copper (I) halide photosensitive material to produce an image having a neutral tone.

A yet further object of the invention is to provide a method of forming such an improved image as above from the copper (I) halide photosensitive material.

These objects of the present invention can be accomplished by an image-forming method wherein a photosensitive material comprising a coated thereon with a photosensitive copper (I) halide emulsion containing grains of the copper (I) halide crystal dispersed in a binder or with the same emulsion containing silver halide is subjected to imagewise exposure and development with an alkaline solution containing at least one compound selected from each of at least two of the following three groups: (A) a group consisting of α-amino acids, α-amino acid derivatives, aliphatic carboxylic acids, oxycarboxylic acids, ketocarboxylic acids, aromatic carboxylic acids, aminocarboxylic acids, quinoline, derivatives, pyridine derivatives, amines and amine derivatives, which amines and amine derivatives form a Cu(II) complex having a stability constant between 5 and 15; (B) a group consisting of 4-aminophenols and 3-pyrazolidones; and (C) a group consisting of ascorbic acid derivatives of the following formula (I) and alkali metal salts thereof:

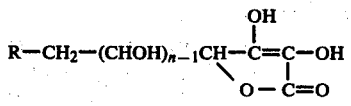

(I)

wherein R is a hydrogen atom or a hydroxyl group, and n is a positive integer of from 1 to 4; provided that when n=1, R represents only a hydroxyl group.

PREFERRED EMBODIMENTS OF THE INVENTION

The photosensitive material used in the present invention is prepared by either one of the following methods: (1) fine grains of the photosensitive copper (I) halide drystal or the same crystal containing silver halide are dispersed in a binder solution to make a copper (I) halide emulsion, which is coated onto a support; and (2) a silver halide emulsion prepared in advance is mixed with a copper (I) halide emulsion having fine grains of the photosensitive copper (I) halide crystal dispersed in a binder, and the resulting emulsion is coated onto a support and dried thereafter. The copper (I) halide emulsion may be produced by dispersing prepared grains of the copper (I) halide crystal in a binder solution, or by reducing cupric ions in a protective colloidal solution in the presence of a halogen ion. More specifically, the desired emulsion is prepared by one of the following methods:

(1) It may be produced by the method described in Research Disclosure No. 15166. In this method, the crystal of copper (I) halide is prepared by the method described in R. N. Keller & H. D. Vikoff, "Inorganic Synthesis", Vol. 1, page 1 (1946), that is, sodium sulfite in an aqueous acidic solution of cupric halide (i.e. cupric chloride or cupric bromide) is subjected to the following reaction wherein the cupric halide is reduced to form large grains of the cuprous halide crystal:

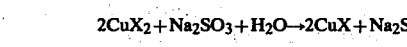

$$2CuX_2+Na_2SO_3+H_2O\rightarrow 2CuX+Na_2SO_4+2HX$$

The resulting large grains of the cuprous halide are ground with a ball mill to produce finer grains, which are redispersed in a solution of a binder in an organic solvent (e.g. acetone or acetonitrile).

(2) The large grains of the copper (I) halide crystal prepared in the first method are ground with a ball mill to produce finer grains, which are redispersed in an aqueous solution of a hydrophilic protective colloid.

(3) The cupric ion of cupric chloride, cupric bromide or a mixture thereof in any content in solution is reduced by treating it in an aqueous acidic solution of a hydrophilic protective colloid with a reducing agent such as sulfurous acid or an alkali metal salt thereof, nitrous acid or an alkali metal salt thereof, L-ascorbic acid or a derivative thereof (e.g. alkali metal salt), or hydrazine or a derivative thereof, to thereby form a dispersion of fine grains of cuprous halide.

(4) An aqueous solution of copper nitrate or its mixture with silver nitrate in any content is mixed with an aqueous solution of an alkali metal halide (e.g. potassium chloride, potassium bromide, potassium iodide, sodium chloride, sodium bromide or sodium iodide) or alkali metal halides in any proportions by the single-jet method or double-jet method in an aqueous acidic solution of a hydrophilic colloid in the presence of a reducing agent such as sulfurous acid, nitrous acid, L-ascorbic acid or alkali metal salts of these acids, hydrazine or its derivative (e.g. phenylhydrazine), to thereby form a dispersion of the fine grains of copper (1) halide-containing silver halide crystal through reduction of the cupric ion.

(5) A silver halide emulsion prepared by the method described in "Fundamentals of Photographic Engineering: Silver Salt Photography", pages 150 and 280, Corona Publishing Company, 1979 is mixed with a copper (I) halide emulsion prepared by either method (2) or (3).

The halide composition used in these emulsions comprises at least one halide selected from among a chloride, bromide and iodide. Examples of the binder or protective colloid incorporated in the emulsion include hydrophobic polymeric compounds such as synthetic polymers like cellulose acetate butyrate and polyvinyl butyral, as well as hydrophilic polymeric compounds such as natural polymers like gelatin, gelatin derivatives, gum arabic, albumin and agar, and synthetic polymers, say polyvinyl alcohol, polyvinyl pyrrolidone, cellulose ether and partially hydrolized cellulose acetate.

A photosensitive material can be prepared by coating the copper (I) halide emulsion onto a support or letting it be absorbed by the support, and the resulting photosensitive material can be developed with the developer. Porous supports such as paper are suitable for use as a support of the type wherein the emulsion is absorbed by it. Conventional film supports can be used for providing a coated emulsion layer, and they include a glass sheet, a metal sheet such as aluminum, copper, zinc or tin plate, polymer sheets such as cellulose acetate, cellulose nitrate, cellulose acetate butyrate, polyethylene terephthalate and polystyrene sheets, baryta paper, and resin-coated paper.

The method of producing an image from the above described copper (I) halide photosensitive material according to the present invention is described hereunder in more detail, Said photosensitive material is subjected to imagewise exposure either in a dry state or in a wet state, and it is subsequently processed by the developer described hereinabove. Light sources that can be used in the exposure step include those which emit visible and/or UV rays, such as a tungsten lamp, xenon lamp, mercury lamp, carbon arc, and halogen lamp, and the exposure may be effected through a transparency or by reflex process.

If the copper (I) halide photosensitive material does not contain silver halide and is comprised of only copper (I) halide, it is not substantially lightsensitive in a dry state as mentioned in Research Disclosure No. 15166 (1976), so no colored image can be produced even if it is subjected to imagewise exposure and development, but in a wet state, the material has light-sensitivity and an image can be produced by subjecting it to imagewise exposure and development. The copper (I) halide photosensitive material may be wetted by a polar solvent such as water, alcohols (e.g. methanol and ethanol) and glycols (ethylene glycol and diethylene glycol) or a developer that has dissolved therein one of the developing agents of the present invention.

If the copper (I) halide photosensitive material is made of a support having a layer of the copper (I) halide emulsion containing silver halide, it is light-sensitive in a dry state and can be subjected to imagewise exposure in a dry state, followed by processing with the developer described above.

One preferred combination of the developing agents to be incorporated in the developer used to process the copper (I) halide photosensitive material or the same material containing silver halide is that of at least one compound selected from the group (A) consisting of α-amino acids, α-amino acid derivatives, aliphatic carboxylic acids, oxycarboxylic acids, ketocarboxylic acids, aromatic carboxylic acids, aminocarboxylic acids, quinoline derivatives, pyridine derivatives, amines and amine derivatives, which amines and amine derivatives form a Cu (II) complex having a stability constant between 5 and 15 and at least one compound selected from the group (C) consisting of ascorbic acid derivatives of the formula (I) and alkali metal salts thereof.

Specific examples of the ascrobic acid derivative of the formula (I) are L-ascorbic acid, araboascorbic acid, 1-erythroascorbic acid and α-glucoascorbic acid, and L-ascrobic acid and alkali metal salts thereof are particularly preferred. The compounds selected from the group (A) that are used together with the ascorbic acid derivatives and alkali metal salts thereof (hereunder collectively referred to as ascorbic acid derivatives) form a complex with a $Cu^{2+}$ ion according to the reaction scheme (2) indicated below, and amines and amine derivatives have a stability constant for such complex between 5 and 15. This stability constant was measured by the pH nitration method at 25° C. and an ionic concentration of 0.1. When the concentrations of the reactants which are in an equilibrium state in the complex-forming reaction (2) are rrpresented by $[Cu^{2+}]$, [M] and [CuM], the equilibrium constant $K_{CuM}$ is represented by formula (3) indicated below, and the stability constant of the resulting complex is expressed by log $K_{CuM}$:

$$Cu^{2+} + M \rightleftarrows CuM \quad (2)$$

wherein M is a compound which forms a complex with $Cu^{2+}$.

$$K_{CuM} = \frac{[CuM]}{[Cu^{2+}]\,[M]} \quad (3)$$

Illustrative α-amine acids and α-amino acid derivatives are listed below:

glycine, sarcosine, alanine, β-alanine, valine, norleucine, leucine, phenylalanine, tyrosine, serine, phosphoserine, threonine, methionine, aspartic acid, asparagine, glutamic acid, ornithine, lysine, arginine, proline, hydroxyproline, histidine, tryptophane, N-ethyglycine, N-n-propylglycine, N-isopropylglycine, N,N-dimethylglycine, N,N-diethylglycine, N,N-bis(2-hydroxyethyl)glycine, N,N-bis(2-hydroxypropyl)glycine, glycylglycine, glycylarcosine, glycylleucine, glycyltyrosine, glycylproline, arcosylglycine, β-alanylhistidine, lysine vasopressin and sodium glutamate.

Illustrative aliphatic carboxylic acid is malonic acid.

Illustrative oxycarboxylic acid is citric acid.

Illustrative ketocarboxylic acid is oxalacidic acid.

Illustrated aromatic carboxylic acids aew salicylic acid and 5-sulfosalicylic acid.

Illustrative quinoline derivatives are listed below: quinoline-2-carboxylic acid and quinoline-8-carboxylic acid.

Illustrative pyridine derivatives are listed below: pyridine-2-carboxylic acid, pyridine-2,6-carboxylic acid, nicotinic acid hydrazide, isonicotinic acid hydrazide, piperidine-2,6-dicarboxylic acid, oxine-5-sulfonic acid, 4-hydroxy-1,5-naphthylridine, 8-hydroxy-1,6-naphthyridine and 8-hydroxy-1,7-naphthyridine.

Illustrative aminocarboxylic acids are listed below: iminodiacetic acid, imidodipropionic acid, N-methyliminodiacetic acid, N-(3,3-dimethylbutyl-)iminodiacetic acid, phenyliminodiacetic acid, hydroxyethyliminodiacetic acid, hydroxyethyliminodipropionic acid, hydroxypropyliminodiacetic acid, 2-hydroxycyclohexyliminodiacetic acid, methoxyethyliminodiacetic acid, N-(carbamoylmethyl)iminodiacetic cid, 2-ethoxycarbonylaminoethyliminodiacetic acid, nitrilotriacetic acid, carboxyethyliminodiacetic acid, carboxymethyliminodipropionic acid, N-n-butylethylenediaminetriacetic acid, N-cyclohexylethylenediaminetriacetic acid, 1-aminocyclopentanecarboxylic acid, 1-aminocyclohexanecarboxylic acid and 1-aminocycloheptanecarboxylic acid.

Illustrative amines and amine derivatives are listed below: ethylenediamine (10.76), N-methyl-ethylenediamine (10.55), N-ethyl-ethylenediamine (10.19), N-n-propylethylenediamine (9.98), N-isopropylethylenediamine (9.07), N-(2-hydroxyethyl)ethylenediamine (10.11), N,N-dimethylethylenediamine (10.53), N,N-diethylethylenediamine (8.17), N,N'-dimethylethylenediamine (10.47), N,N'-diethylethylenediamine (9.30), N,N'-di-n-propylethylenediamine (8.79), N,N'-di(2-hydroxyethyl)ethylenediamine (9.77), N,N,N'N'-tetramethylethylenediamine (11.63), 1,2-diaminopropane (10.78), meso-2,3-diaminobutane (10.72), rac-2,3-diaminobutane, trimethylenediamine (9.77), cis-1,2-diaminocyclohexane (10.87), trans-1,2-diaminocyclohexane (11.13), trans-1,2-diaminocycloheptane (11.04), 1,2,3-triaminopropane (11.1), 1,3-diamino-2-aminomethylpropane (10.85), 3,3'-diaminodipropylamine (14.25), di(2-aminoethyl)ether (8.82), 2-aminomethylpyridine (9.45), pyridoxamine (10.22), histamine (9.55) and 3-methylhistamine (9.58). The value in the parentheses indicates the stability constant.

Another preferred combination of the developing agents to be incorporated in the developer used in processing the copper (I) halide photosensitive material and the same material containing silver halide is that of at least one compound selected from the group (B) consisting of 4-aminophenols and 3-pyrazolidones, and at least one compound selected from the group (C). Preferred 4-aminophenols that are used in admixture with the ascorbic acid derivatives include 4-N-methylaminophenol sulfate, 4-N-benzylaminophenol hydrochloride, 4-N,N-diethylaminophenol hydrochloride, 4-aminophenol sulfate, 1-oxymethyl-4-aminophenol hydrochloride, 2,4-diaminophenol, and 4-N-carboxymethylaminophenol-p-oxyphenylglycine. Preferred 3-pyrazolidones that can also be used in admixture with the ascorbic acid derivatives include 1-phenyl-3-pyrazolidone, 4,4-dimethyl-1-phenyl-3-pyrazolidone and 4-methyl-phenyl-3-pyrazolidone.

Still another preferred combination of the developing agents is that of at least one compound selected from the group (A) and at least one compound selected from the group (B). For preferred examples of each group of compounds, see the lists given above.

Preferred solvents for use in the developer of the present invention include polar solvents such as pure water, alcohols (e.g. methyl alcohol and ethyl alcohol) and glycols (e.g. ethylene glycol and diethylene glycol), and these solvents may be used either alone or in admixture at any content.

The developer of the present invention may contain various additives to improve the development characteristics (e.g. development speed and keeping quality of the developer) and the quality of the image (prevention of fog). Typical additives include alkaline reagents (e.g. hydroxides, carbonates and phosphates of alkali metals and ammonia), pH modifying agents or buffers (e.g. weak acids such as acetic acid and boric acid, weak bases, and salts thereof), and preservatives (e.g. sulfites and formaldehyde sulfite adducts). Other additives are 4-aminophenols such as Metol and Phenidone.

When a developer made of an alkaline solution containing at least one compound selected from the group (A) and at least one compound selected from the group (C) is used, the concentration of each developing agent varies greatly depending upon its type. Preferably, the ascorbic acid derivative is used in an amount of 0.05 to 1.0 mol/liter, and an amount between 0.1 and 0.5 mol/liter is particularly preferred. The compounds selected from the group (A) are preferably used in an amount of from 0.01 to 2.0 mol/liter, and an amount between 0.05 and 1.0 mol/liter is particularly preferred. If the amount of the α-amino acid compound is less than 0.01 mol/liter, the resulting developer does not have the desired superadditivity for any concentration of the ascorbic acid derivative between 0.05 and 1.0 mol/liter, and the final image has low color density. If the amount of the ascorbic acid derivative is less than 0.05 mol/liter, the ability of the developer is close to that of a developer made of only the α-amino acid compound, and the final image has low color density and contrast. If the amount of the ascorbic acid derivative is more than 1.0 mol/liter or the α-amino acid compound is more than 2.0 mols/liter, the developer has a tendency to cause fog.

When a developer made of an alkaline solution containing at least one compound selected from the group (B) and at least one compound selected from the group (C) is used, the concentration of each developing agent also varies greatly according to its type. Preferably, the ascorbic acid derivative is used in an amount of 0.05 to 1.0 mol/liter, and an amount between 0.1 and 0.5 mol/liter is particularly preferred. The 4-aminophenol and/or 3-pyrazolidone is preferably used in an amount of from 0.01 to 2.0 mol/liter, and an amount between 0.05 and 1.0 mol/liter is particularly preferred. If the amount of the 4-aminophenol and/or 3-pyrazolidone is less than 0.01 mol/liter, the resulting developer does not have the desired super-additivity for any concentration of the ascorbic acid derivative between 0.05 and 1.0 mol/liter, and the final image has low color density. If the amount of the ascorbic acid derivative is less than 0.05 mol/liter, the ability of the developer is close to that of a developer made of only the 4-aminophenol or 3-pyrazolidone, and the final image has low color density and contrast. If the amount of the ascorbic acid derivative is more than 1.0 mol/liter or the 4-aminophenol and/or 3-pyrazolidone is more than 2.0 mol/liter, the developer has a tendency to cause fog. Since compounds selected from the group consisting of 4-aminophenols and 3-pyrazolidones have low solubility in water, the 4-aminophenols are preferably used in an amount of not more than 0.2 mol/liter, and the 3-pyrazolidones are preferably used in an amount of not more than 0.1 mol/liter.

When a developer made of an alkaline solution containing at least one compound selected from the group (A) and at least one compound selected from the group (B) is used, the concentration of each developing agent also varies greatly depending upon its type. Preferably, the 4-aminophenols are used in an amount ranging from 0.05 to 0.5 mol/liter, and a value between 0.03 and 0.2 mol/liter is more preferred. The 3-pyrazolidones are preferably used in an amount of from 0.01 to 0.2 mol/liter, and a value between 0.03 and 0.1 mol/liter is more preferred. If the amount of the 4-aminophenol or 3-pyrazolidone is less than 0.03 mol/liter, the developer does not have the desired superadditivity even if the other developing agent is used in the amount indicated below. If the amount of the 4-aminophenol is more than 0.5 mol/liter or the 3-pyrazolidone is more than 0.2 mol/liter, they will not dissolve in any solvent under any condition. The other developing agent, i.e. the α-amino acid compound is used in an amount of from 0.01 to 2.0 mol/liter, and a value between 0.05 and 1.0 mol/liter is more preferred. If the concentration of the α-amino acid compound is less than 0.01 mol/liter, the developer does not have the desired superadditivity even if the 4-aminophenol or 3-pyrazolidone is used in an amount between 0.05 and 0.5 mol/liter. If the amount of the α-amino acid compound is more than 2.0 mols/liter, the developer has a tendency to fog.

The pH of the developer is preferably adjusted to a value between 7 and 14, more preferably between 8 and 13, by one of the alkaline reagents or buffers listed above. At a pH of less than 7, the developer does not have sufficient activity to produce the desired color image. If there is the need of using a preservative, one of the compounds mentioned above is preferably used in an amount ranging from $2.0\times10^{-2}$ to $2.0\times10^{-1}$ mols/liter, more preferably between $4.0\times10^{-2}$ and $1.5\times10^{-1}$ mols/liter. Whichever combination of developing agent is used, the development period is preferably between 30 seconds and 10 minutes, more preferably between 1 and 7 minutes, and the development temperature is preferably between 10° and 50° C., more preferably between 15° and 40° C.

As described in the intoroductory part of this specification, the method of Harry T. Spencer et al. that develops a copper (I) halide photosensitive material with an alkaline aqueous solution of triethylenetetramine provides an image having high fog density and low contrast. But according to the method of the present invention, the developer exhibits superadditivity in development of the same copper (I) halide photosensitive material and, an image that has low fog density and which yet enjoys a high maximum color density, high contrast and a neutral tone can be produced.

The present invention is now described in greater detail by reference to the following examples and comparative examples which are given here for illustrative purposes only and are by no means intended to limit its scope.

EXAMPLE 1

A copper (I) iodobromide emulsion was prepared from the following three solutions.

| | | |
|---|---|---|
| Solution-1 | Ossein gelatin | 50 g |
| | Pure water | 1,000 ml |
| | KBr | 85.7 g |
| Solution-2 | KI | 2.2 g |
| | L-ascorbic acid | 79.2 g |
| | Pure water | 1.575 ml |
| Solution-3 | $Cu(NO_3)_2.3H_2O$ | 106 g |
| | Pure water | 2,000 ml |

Solution-1 was held at 45° C. under stirring, and the addition of Solution-2 and Solution-3 started simultaneously. Solution-2 was added over a period of 3 minutes at a rate of 525 ml/min and Solution-3 was added over a period of 5 minutes. The temperature of physical ripening was held at 45° C., and after the addition of Solution-3 was completed, the mixture was subjected to further physical ripening for 10 minutes. A 5% aqueous solution of Demor-N (product of Kao-Atlas Co., Ltd.) and a 30% aqueous solution of magnesium sulfate were added in a ratio of 1:7 to the mixture until a precipitate formed. When the mixture was left to stand, fine grains of the cuprous iodobromide crystal settled, and after decantation, 3000 ml of distilled water was added to redisperse the precipitate. A 30% aqueous solution of magnesium sulfate was again added until a precipitate formed. The mixture was left to stand, and when cuprous iodobromide grains settled, the supernatant was decanted and an aqueous solution containing 45 g of ossein gelatin was added. The cuprous iodobromide grains were dispersed in the gelatin solution by stirring it for 30 minutes at 40° C., and thereafter, distilled water was added to make an emulsion having a total volume of 600 ml.

The emulsion was mixed with a surfactant (coating aid) and a hardener to make its volume 675 ml. It was then coated onto a polyethylene terephthalate film support in a wet thickness of 80μ and dried at 60° C. for 30 minutes to prepare photosensitive material A. Analysis by X-ray photometry showed that this photosensitive material contained 32 mg of cuprous halide for 100 $cm^2$ in terms of metallic copper. Samples of photosensitive material A were immersed for 30 seconds at 20° C. in developers of the composition indicated below that contained L-ascorbic acid and the α-amino acids noted in Table 1, and thereafter, the samples were given an exposure of $10^4$ erg/$cm^2$ by a source of UV radiation (260–420μ) through an optical wedge (optical density of each step: 0.1) in a wet state. The exposed samples were developed with developers of the same compositions as used above at 25° C. for optimum periods ranging from 1 to 5 minutes. The developed samples were fixed for 5 minutes or longer by a fixing solution of the composition indicated below. The fixed samples were washed with water and dried.

Developer

| | |
|---|---|
| L-ascorbic acid | 0.183 mol |
| α-Amino acid | 0.40 mol |
| Sodium metaborate | 0.026 mol |
| Pure water to make | 1,000 ml |

(All developers were adjusted to a pH of 9 by aqueous sodium hydroxide or dilute sulfuric acid.)

Fixing solution

| | |
|---|---|
| Sodium thiosulfate | 240 g |
| Sodium sulfite | 10 g |
| Sodium hydrogensulfite | 25 g |
| Pure water to make | 1,000 ml |

The results of sensitometry of the photographic images formed on the processes samples, as well as the names of the α-amino acids included in the developers are listed in Table 1.

TABLE 1

| Sample No. | Developing agent | Concentration (g/l) | Dmin | Dmax | γ |
|---|---|---|---|---|---|
| 1 | L-ascorbic acid<br>L-glutamine | 30<br>58.4 | 0.03 | 3.20 | 0.95 |
| 2 | L-ascorbic acid<br>DL-alanine | 30<br>35.6 | 0.03 | 3.15 | 1.00 |
| 3 | L-ascorbic acid<br>L-lysine | 30<br>58.5 | 0.02 | 3.18 | 1.05 |
| 4 | L-ascorbic acid<br>L-aspartic acid | 30<br>53.2 | 0.03 | 3.32 | 1.15 |
| 5 | L-ascorbic acid<br>α-aminoisobutyric acid | 30<br>41.2 | 0.02 | 3.24 | 1.07 |
| 6 | L-ascorbic acid<br>L-leucine | 30<br>17.0 | 0.03 | 3.00 | 1.02 |

EXAMPLE 2

Samples of photosensitive material A which were the same as prepared in Example 1 were immersed for 30 seconds at 20° C. in developers of the composition indicated below that contained sodium L-ascorbate and the amines noted in Table 2, and thereafter, the samples were given an exposure of $10^4$ erg/cm$^2$ by a source of UV radiation (260–420μ) through an optical wedge (optical density of each step: 0.1) in a wet state. The exposed samples were developed with developers of the same compositions as used above at 25° C. for optimum periods ranging from 1 to 10 minutes. The developed samples were fixed in a hypo bath, washed with water and dried as in Example 1.

Developer

| | |
|---|---|
| Sodium L-ascrobate | 0.2 mol |
| Amine | 0.25 mol |
| Sodium metaborate | 0.026 mol |
| Pure water to make | 1,000 ml |

(All developers were adjusted to a pH of 8.2 by aqueous sodium hydroxide or dilute sulfuric acid.)

The results of sensitometry of the photographic images formed on the processed samples, as well as the names of the amines included in the developers are listed in Table 2.

TABLE 2

| Sample No. | Developing agent | Concentration (g/l) | Dmin | Dmax | γ |
|---|---|---|---|---|---|
| 7 | Sodium L-ascorbate<br>Ethylenediamine (10.76)* | 37.2<br>15 | 0.03 | 3.30 | 1.10 |
| 8 | Sodium L-ascorbate<br>N—methylethylene-diamine (10.55) | 37.2<br>18.5 | 0.03 | 3.35 | 1.14 |
| 9 | Sodium L-ascorbate<br>N—n-propylethylene-diamine (9.98) | 37.2<br>25.5 | 0.02 | 3.15 | 1.06 |
| 10 | Sodium L-ascorbate<br>N,N—dimethylethylene-diamine (8.17) | 37.2<br>22.0 | 0.03 | 3.21 | 1.08 |
| 11 | Sodium L-ascorbate<br>1,2-diaminopropane (10.78) | 37.2<br>18.5 | 0.02 | 3.26 | 1.10 |
| 12 | Sodium L-ascorbate<br>Trimethylenediamine (9.77) | 37.2<br>18.5 | 0.02 | 3.18 | 1.05 |
| 13 | Sodium L-ascorbate<br>1,2,3-triaminopropane (11.1) | 37.2<br>22.25 | 0.03 | 3.38 | 1.17 |
| 14 | Sodium L-ascorbate<br>N—ethylethylenediamine (10.19) | 37.2<br>22.0 | 0.02 | 3.24 | 1.08 |

*The stability constant measured by the method defined above.

EXAMPLE 3

A photographic emulsion comprising fine grains of the copper (I) iodobromide crystal and silver iodobromide was prepared from the following three solutions.

| | | |
|---|---|---|
| Solution-4 | Ossein gelatin | 20.0 g |
| | KBr | 15.0 g |
| | Distilled water | 600 ml |
| Solution-5 | KBr | 33.6 g |
| | KI | 4.74 g |
| | L-ascorbic acid | 64.8 g |
| | Distilled water | 945 ml |
| Solution-6 | $Cu(NO_3)_2 3H_2O$ | 63.6 g |
| | $AgNO_3$ | 4.5 g |
| | Distilled water | 420 ml |

Solution-4 was held at 45° C. under stirring, and Solution-5 and Solution-6 began to be added simultaneously by the double-jet method. Solution-5 was added over a period of 3 minutes at a rate of 315 ml/min and Solution-6 was added over a period of 3 minutes and 30 seconds at a rate of 120 ml/min. After completion of the addition of Solution-6, the mixture was held at 45° C.

for 10 munutes to effect physical ripening, and it was washed with water and desalted as in Example 1. An aqueous solution containing 17.6 g of ossein gelatin was poured over the precipitate of copper (I) iodobromide and silver iodobromide. The halide grains were re-dispersed in the gelatin solution by stirring it for 30 minutes at 45° C., and therafter, distilled water was added to make an emulsion having a total volume of 380 ml.

The emulsion was mixed with a surfactant (coating aid) and a hardener to increase its volume to 450 ml. It was then coated onto a polyethylene terephthalate film support in a wet thickness of 80μ and dried at 60° C. for 30 minutes to prepare photosensitive material B. Analysis by X-ray fluorometry showed that this photosensitive material contained 5.0 mg of metallic silver and 29.5 mg of metallic copper per 100 $cm^2$. Samples of the photosensitive material B were given an exposure of $10^4$ erg/$cm^2$ by a source of UV radiation (260–420μ) through an optical wedge (optical density of each step: 0.1) in a dry state. The exposed samples were developed for 7 minutes at 25° C. with developers of the composition indicated below that contained L-ascorbic acid and the α-amino acids or their derivatives noted in Table 3. The developed samples were then fixed and washed with water as in Example 1.

Developer

| | |
|---|---|
| L-ascrobic acid | 0.25 mol |
| α-Amino acids or their derivatives | 0.3 mol |
| Sodium metaborate | 0.026 mol |
| Pure water to make | 1,000 ml |

(All developers were adjusted to a pH of 8.0 by aqueous sodium hydroxide or dilute sulfuric acid.)

The results of sensitometry of the photographic images formed on the processed samples, as well as the names of the α-amino acids and their derivatives are listed in Table 3.

TABLE 3

| Sample No. | Developing agent | Concentration (g/l) | Dmin | Dmax | γ |
|---|---|---|---|---|---|
| 15 | L-ascorbic acid | 41.0 | 0.03 | 3.90 | 1.53 |
| | Cysteic acid | 50.8 | | | |

TABLE 3-continued

| Sample No. | Developing agent | Concentration (g/l) | Dmin | Dmax | γ |
|---|---|---|---|---|---|
| 16 | L-ascorbic acid | 41.0 | 0.02 | 3.80 | 1.48 |
| | Serine | 31.5 | | | |
| 17 | L-ascorbic acid | 41.0 | 0.03 | 3.72 | 1.40 |
| | Sarcosine | 26.7 | | | |
| 18 | L-ascorbic acid | 41.0 | 0.03 | 3.78 | 1.47 |
| | Threonine | 35.7 | | | |
| 19 | L-ascorbic acid | 41.0 | 0.02 | 3.85 | 1.53 |
| | Glutamic acid | 44.1 | | | |
| 20 | L-ascorbic acid | 41.0 | 0.02 | 3.75 | 1.45 |
| | Ornithine | 39.6 | | | |
| 21 | L-ascorbic acid | 41.0 | 0.03 | 3.87 | 1.50 |
| | Glycine | 22.5 | | | |
| 22 | L-ascorbic acid | 41.0 | 0.02 | 3.70 | 1.45 |
| | Lysine (hydrochloride) | 43.8 | | | |
| 23 | L-ascorbic acid | 41.0 | 0.15 | 3.65 | 1.25 |
| | Arginine | 52.3 | | | |
| 24 | L-ascorbic acid | 41.0 | 0.03 | 3.75 | 1.34 |
| | Glycineamide | 22.2 | | | |

EXAMPLE 4

Samples of photosensitive material B which were the same as prepared in Example 3 were given an exposure of $10^4$ erg/$cm^2$ by a source of UV radiation (260–420μ) through an optical wedge (optical density of each step: 0.1) in a dry state. The samples were then developed for 4 minutes at 25° C. with developers of the composition indicated below that contained sodium D-araboascorbate and the aminocarboxylic acids noted in Table 4. The developed samples were fixed and washed with water as in Example 1.

Developer

| | |
|---|---|
| Sodium D-araboascorbate | 0.3 mol |
| Aminocarboxylic acid | 0.5 mol |
| Sodium metaborate | 0.03 mol |
| Pure water to make | 1,000 ml |

(All developers were adjusted to a pH of 8.2 with aqueous sodium hydroxide or dilute sulfuric acid.)

The results of sensitometry of the photographic images formed on the processed samples, as well as the names of the aminocarboxylic acids included in the developers are listed in Table 4.

TABLE 4

| Sample No. | Developing agent | Concentration (g/l) | Dmin | Dmax | γ |
|---|---|---|---|---|---|
| 25 | Sodium D-arabo-ascorbate | 59.4 | 0.02 | 3.45 | 1.20 |
| | Iminodiacetic acid | 66.5 | | | |
| 26 | Sodium D-arabo-ascorbate | 59.4 | 0.03 | 3.50 | 1.30 |
| | Iminodipropionic acid | 80.5 | | | |
| 27 | Sodium D-arabo-ascorbate | 59.4 | 0.03 | 3.37 | 1.25 |
| | N(3,3-dimethyl-butyl)iminodiacetic acid | 108.5 | | | |
| 28 | Sodium D-arabo-ascorbate | 59.4 | 0.02 | 3.40 | 1.25 |
| | Hydroxyethylimino-diacetic acid | 88.5 | | | |
| 29 | Sodium D-arabo-ascorbate | 59.4 | 0.02 | 3.60 | 1.20 |
| | Carboxyethylimino-diacetic acid | 102.5 | | | |
| 30 | Sodium D-arabo- | 59.4 | 0.03 | 3.70 | 1.35 |

TABLE 4-continued

| Sample No. | Developing agent | Concentration (g/l) | Dmin | Dmax | γ |
|---|---|---|---|---|---|
| | ascorbate | | | | |
| | N—(carbamoylmethyl) iminodiacetic acid | 95 | | | |
| 31 | Sodium D-arabo-ascorbate | 59.4 | 0.02 | 3.45 | 1.23 |
| | Nitrilotriacetic acid | 95.5 | | | |

EXAMPLE 5

Samples of photosensitive material B which were the same as prepared in Example 3 were given an exposure of $10^4$ erg/cm$^2$ by a source of UV radiation (260–420μ) through an optical wedge (optical density of each step: 0.1) in a dry state. The samples were then developed for 4 minutes at 25° C. with developers of the composition indicated below that contained L-ascorbic acid and the alkylamines noted in Table 5. The developed samples were fixed and washed with water as in Example 1.

Developer

| | |
|---|---|
| L-ascorbic acid | 0.25 mol |
| Alkylamine | 0.25 mol |
| Sodium metaborate | 0.05 mol |
| Pure water to make | 1,000 ml |

(All developers were adjusted to a pH of 9.0 by aqueous sodium hydroxide or dilute sulfuric acid.)

The results of sensitometry of the photographic images formed on the processed samples, as well as the names of the alkylamines included in the developers are listed in Table 5.

TABLE 5

| Sample No. | Developing agent | Concentration (g/l) | Dmin | Dmax | γ |
|---|---|---|---|---|---|
| 32 | L-ascorbic acid | 41.0 | 0.04 | 3.15 | 1.05 |
| | Ethylenediamine (10.76)* | 15 | | | |
| 33 | L-ascorbic acid | 41.0 | 0.03 | 3.30 | 1.10 |
| | N—methylethylene-diamine (10.55) | 18.5 | | | |
| 34 | L-ascorbic acid | 41.0 | 0.04 | 3.40 | 1.00 |
| | 1,2-diaminopropane (10.78) | 18.5 | | | |
| 35 | L-ascorbic acid | 41.0 | 0.03 | 3.20 | 0.95 |
| | N,N—dimethylethyl-enediamine (10.47) | 22 | | | |

*The stability constant measured by the method defined above.

EXAMPLE 6

Samples of photosensitive material A which were the same as prepared in Example 1 were immersed for 30 seconds at 20° C. in developers of the composition indicated below that contained L-ascorbic acid and the 4-aminophenols or 3-pyrazolidones noted in Table 6, and thereafter, the samples were given an exposure of $10^4$ erg/cm$^2$ by a source of UV radiation (260–420μ) through an optical wedge (optical density of each step: 0.1) in a wet state. The exposed samples were developed with developers of the same compositions as used above at 25° C. for optimum periods between 1 and 10 minutes. The developed samples were fixed in a hypo bath, washed with water and dried as in Example 1.

Developer

| | |
|---|---|
| 4-Aminophenol | 0.085 mol |
| 3-Pyrazolidone | 0.06 mol |
| L-ascorbic acid | 0.2 mol |
| Sodium metaborate | $2.6 \times 10^{-2}$ mol |
| Pure water to make | 1,000 ml |

(All developers were adjusted to a pH of 8.4 with aqueous sodium hydroxide or dilute sulfuric acid.)

The results of sensitometry of the photographic images formed on the processed samples, as well as the names of the 4-aminophenols and 3-pyrazolidones included in the developers are listed in Table 6.

TABLE 6

| Sample No. | Developing agent | Concentration (g/l) | Dmin | Dmax | γ |
|---|---|---|---|---|---|
| 36 | L-ascorbic acid | 32.8 | 0.3 | 3.85 | 1.50 |
| | 4-aminophenol sulfate | 17.6 | | | |
| 37 | L-ascorbic acid | 32.8 | 0.3 | 3.80 | 1.55 |
| | 4-N—methylamino-phenol hemisulfate | 14.6 | | | |
| 38 | L-ascorbic acid | 32.8 | 0.3 | 4.00 | 1.65 |
| | P—oxyphenylglycine | 14.2 | | | |
| 39 | L-ascorbic acid | 32.8 | 0.2 | 3.70 | 1.35 |
| | 1-phenyl-3-pyrazolidone | 9.7 | | | |
| 40 | L-ascorbic acid | 32.8 | 0.2 | 3.75 | 1.40 |
| | 4-methylphenyl-3-pyrazolidone | 10.6 | | | |

EXAMPLE 7

Samples of photosensitive material B were prepared as in Example 3. Analysis by X-ray fluorometry showed that each sample contained 5.0 mg of metallic silver and 39.5 mg of metallic copper for 100 cm$^2$. The samples were given an exposure of $10^4$ erg/cm$^2$ by a source of UV radiation (260–420μ) through an optical wedge (optical density of each step: 0.1) in a dry state. The samples were then developed for 7 minutes at 25° C. with developers of the composition indicated below that contained L-ascorbic acid and the 4-aminophenols noted in Table 7. The developed samples were fixed in a hypo bath, washed with water and dried as in Example 1.

Developer

| | |
|---|---|
| L-ascorbic acid | 0.2 mol |
| 4-Aminophenol | 0.1 mol |
| Sodium metaborate | 0.026 mol |
| Pure water to make | 1,000 ml |

(All developers were adjusted to a pH of 8.5 by aqueous sodium hydroxide or dilute sulfuric acid.)

The results of sensitometry of the photographic images formed on the processed samples, as well as the names of the 4-aminophenols included in the developers are listed in Table 7.

TABLE 7

| Sample-No. | Developing agent | Concentration (g/l) | Dmin | Dmax | γ |
|---|---|---|---|---|---|
| 41 | L-ascorbic acid | 32.8 | 0.02 | 4.00 | 1.50 |
| | 1-hydroxymethyl-4-aminophenol hydrochloride | 17.6 | | | |
| 42 | L-ascorbic acid | 32.8 | 0.03 | 3.95 | 1.60 |
| | 4-N—methylamino-phenol hemisulfate | 17.2 | | | |
| 43 | L-ascorbic acid | 32.8 | 0.03 | 4.05 | 1.55 |
| | 4-N—benzylamino-phenol hydro-chloride | 23.5 | | | |
| 44 | L-ascorbic acid | 32.8 | 0.03 | 4.00 | 1.50 |
| | 4-N,N—diethylamino-phenol hydro-chloride | 177.5 | | | |

EXAMPLE 8

Samples of photosensitive material B whic were the same as prepared in Example 3 were given an exposure of $10^4$ erg/cm$^2$ by a source of UV radiation (260–420μ) through an optical wedge (optical density of each step: 0.1) in a dry state. Thereafter, the samples were developed for 5 minutes at 25° C. with developers of the composition indicated below that contained L-ascorbic acid and the 4-aminophenols or 3-pyrazolidones noted in Table 8. The samples were fixed in a hypo bath, washed with water and dried as in Example 1.

Developer

| | |
|---|---|
| L-ascorbic acid | 0.2 mol |
| 4-Aminophenol | 0.03 mol |
| 3-Pyrazolidone | 0.03 mol |
| Sodium metaborate | 0.026 mol |
| Pure water to make | 1,000 ml |

(All developers were adjusted to a pH of 8.2 by aqueous sodium hydroxide or dilute sulfuric acid).

The results of sensitometry of the photographic images formed on the processed samples, as well as the names of the 4-aminophenols and 3-pyrazolidones included in the developers are listed in Table 8.

TABLE 8

| Sample No. | Developing agent | Concentration (g/l) | Dmin | Dmax | γ |
|---|---|---|---|---|---|
| 45 | L-ascorbic acid | 32.8 | 0.02 | 3.86 | 1.30 |

TABLE 8-continued

| Sample No. | Developing agent | Concentration (g/l) | Dmin | Dmax | γ |
|---|---|---|---|---|---|
| | 4-N—methylamino-phenol sulfate | 5.16 | | | |
| | 1-phenyl-3-pyrazolidone | 4.86 | | | |
| 46 | L-ascorbic acid | 32.8 | 0.02 | 3.90 | 1.40 |
| | 4-N—methylamino-phenol sulfate | 5.16 | | | |
| | 4-methylphenyl-3-pyrazolidone | 5.28 | | | |
| 47 | L-ascorbic acid | 32.8 | 0.03 | 4.00 | 1.35 |
| | 4-aminophenyl sulfate | 6.21 | | | |
| | 1-phenyl-3-pyrazolidone | 4.86 | | | |
| 48 | L-ascorbic acid | 32.8 | 0.03 | 3.95 | 1.37 |
| | 4-aminophenol sulfate | 6.21 | | | |
| | 1-phenyl-3-pyrazolidone | 5.28 | | | |

EXAMPLE 9

Samples of photosensitive material A which were the same as prepared in Example 1 were immersed in developers of the composition indicated below that contained the developing agents noted in Table 9, and thereafter, they were given an exposure of $10^4$ erg/cm$^2$ by a source of UV radiation (260–420μ) through an optical wedge (optical density of each step: 0.1) in a wet state. The exposed samples were developed with developers of the same compositions as used above. For the development temperatures and periods, see Table 9. The developed samples were fixed in a fixing bath (20° C.) of the composition indicated below for 5 minutes. Upon washing with water and drying, a black nonsilver image was formed on each sample. The results of sensitometry of the images are shown in Table 9.

Developer

| | |
|---|---|
| Developing agents | (see Table 9) |
| Sodium sulfite | 10 g |
| Sodium metaborate | 25 g |
| Pure water to make | 1,000 ml |

Fixing solution

| | |
|---|---|
| Sodium thiosulfate | 240 g |
| Sodium sulfite | 10 g |
| Sodium hydrogensulfite | 25 g |
| Pure water to make | 1,000 ml |

TABLE 9

| Sample No. | Developing agent (g) | | pH of developer | Development temp. (°C.) | Development period (min) | Image quality Dmin | Dmax | γ |
|---|---|---|---|---|---|---|---|---|
| 49 | 4-N—methylamino-phenol sulfate | 15 | 10.0 | 25 | 3 | 0.03 | 2.90 | 1.05 |
| | L-glutamine | 43.8 | | | | | | |
| 50 | 4-N—methylamino-phenol sulfate | 17 | 9.5 | 20 | 2 | 0.02 | 3.30 | 1.10 |
| | L-cyteic acid | 135 | | | | | | |
| 51 | 4-N—methylamino-phenol sulfate | 5.0 | 9.0 | 20 | 2 | 0.02 | 2.80 | 1.00 |
| | L-histidine | 108.0 | | | | | | |
| 52 | 4-N—methylamino- | 5.0 | 10 | 35 | 3 | 0.03 | 3.15 | 1.05 |

TABLE 9-continued

| Sample No. | Developing agent (g) | | pH of developer | Development temp. (°C.) | Development period (min) | Image quality Dmin | Dmax | γ |
|---|---|---|---|---|---|---|---|---|
| | phenol sulfate | | | | | | | |
| | Asparagine | 66.0 | | | | | | |
| 53 | 4-N—methylamino-phenol sulfate | 15 | 10 | 25 | 3 | 0.03 | 3.20 | 1.10 |
| | L-glutamine | 58.5 | | | | | | |
| 54 | 4-N—methylamino-phenol sulfate | 15 | 10 | 25 | 3 | 0.03 | 3.23 | 1.15 |
| | Glycine | 30 | | | | | | |
| 55 | 4-N—benzylamino-phenol hydro-chloride | 20 | 10 | 35 | 2 | 0.04 | 3.25 | 1.05 |
| | L-aspartic acid | 40.0 | | | | | | |
| 56 | 4-N—benzylamino-phenol hydro-chloride | 18 | 8.5 | 25 | 3 | 0.02 | 3.15 | 1.07 |
| | DL-serine | 42 | | | | | | |
| 57 | 4-N—carboxyamino-phenol | 25 | 9.0 | 25 | 3 | 0.04 | 3.05 | 1.15 |
| | Glycineamide | 29.6 | | | | | | |
| 58 | 4-N—methylamino-phenol sulfate | 10 | 8.2 | 20 | 2 | 0.10 | 3.10 | 0.95 |
| | Ethylenediamine (10.76)* | 60 | | | | | | |
| 59 | 4-N—methylamino-phenol sulfate | 7 | 8.0 | 20 | 2 | 0.09 | 3.15 | 1.05 |
| | N—methylethylene-diamine (10.55)* | 51.8 | | | | | | |
| 60 | 4-N—methylamino-phenol sulfate | 15 | 10.0 | 20 | 2 | 0.08 | 3.10 | 1.10 |
| | N—(2-hydroxyethyl)-ethylenediamine (10.11)* | 31.2 | | | | | | |
| 61 | 4-N—methylamino-phenol sulfate | 10 | 9.5 | 25 | 3 | 0.05 | 3.15 | 1.00 |
| | 2-aminomethyl-pyridine | 27.0 | | | | | | |
| 62 | 4-N—methylamino-phenol sulfate | 15 | 10.0 | 25 | 2 | 3.00 | 3.00 | 1.10 |
| | N—methylimino-diacetic acid | 37 | | | | | | |
| 63 | 4-N—methylamino-phenol sulfate | 15 | 10 | 25 | 2 | 3.05 | 3.05 | 1.15 |
| | Carboxyethylimino-diacetic acid | 42 | | | | | | |

*The stability constant measured by the method defined above.

EXAMPLE 10

Samples of photosensitive material A which were the same as prepared in Example 1 were immersed for 30 seconds at 20° C. in developers of the composition indicated below that contained the developing agents noted in Table 10. In such a wet state, the samples were given an exposure of $10^4$ erg/cm$^2$ by a source of UV radiation (260–420μ) through an optical wedge (optical density of each step: 0.1). Then, the samples were developed with developers of the same compositions as used above (for the development temperatures and periods, see Table 10), and subsequently fixed in a fixing bath (20° C.) of the same composition as used in Example 9 for 5 minutes. Upon washing with water and drying, a black non-silver image was formed on each sample. The results of sensitometry of the images are shown in Table 10.

Developer

| | |
|---|---|
| Developing agents | (see Table 10) |
| Sodium sulfite | 10 g |
| Sodium metaborate | 30 g |
| Ethylene glycol | 50 g |
| Pure water to make | 1,000 ml |

TABLE 10

| Sample No. | Developing agent (g) | | pH of developer | Development temp. (°C.) | Development period (min) | Image quality Dmin | Dmax | γ |
|---|---|---|---|---|---|---|---|---|
| 64 | 1-phenyl-3-pyra-zolidone | 10 | 10.0 | 20 | 2 | 0.03 | 3.20 | 1.25 |
| | Sarcosine | 62.3 | | | | | | |
| 65 | 1-phenyl-3-pyra-zolidone | 15 | 9.5 | 20 | 2 | 0.03 | 3.25 | 1.30 |
| | DL-valine | 30 | | | | | | |
| 66 | 1-phenyl-3-pyra- | 15 | 11.0 | 35 | 1 | 0.04 | 3.00 | 1.05 |

TABLE 10-continued

| Sample No. | Developing agent (g) | | pH of developer | Development temp. (°C.) | Development period (min) | Image quality Dmin | Dmax | γ |
|---|---|---|---|---|---|---|---|---|
| | zolidone | | | | | | | |
| | L-tryptophane | 51 | | | | | | |
| 67 | 1-phenyl-3-pyrazolidone | 15 | 10.0 | 25 | 7 | 0.02 | 2.90 | 1.00 |
| | maloic acid | 52 | | | | | | |
| 68 | 1-phenyl-3-pyrazolidone | 7 | 10.0 | 25 | 5 | 0.02 | 3.10 | 1.10 |
| | Salicylic acid | 69 | | | | | | |
| 69 | 1-phenyl-3-pyrazolidone | 5 | 11.0 | 25 | 2 | 0.08 | 3.15 | 1.15 |
| | N—n-propylethylenediamine (9.98)* | 25.5 | | | | | | |
| 70 | 1-phenyl-3-pyrazolidone | 5 | 11.0 | 25 | 2 | 0.10 | 3.20 | 1.20 |
| | N,N—diethylethylene diamine (9.30)* | 34.8 | | | | | | |
| 71 | 1-phenyl-3-pyrazolidone | 10 | 9.0 | 25 | 3 | 0.05 | 3.10 | 1.10 |
| | Pyridine dicarboxylic acid | 13.5 | | | | | | |
| 72 | 1-phenyl-3-pyrazolidone | 5 | 9.5 | 25 | 3 | 0.08 | 3.00 | 1.10 |
| | Phenylimino diaceticacid | 37 | | | | | | |
| 73 | 4-methylphenyl tripyrazolidone | 10 | 8.5 | 25 | 2 | 0.02 | 3.25 | 1.20 |
| | N,N—dimethylglycine | 30.9 | | | | | | |
| 74 | 4-methylphenyltripyrazolidone | 10 | 10.0 | 25 | 2 | 0.03 | 3.07 | 1.15 |
| | Glycylsarcosine | 36.5 | | | | | | |
| 75 | 4-methylphenyltripyrazolidone | 10 | 10 | 25 | 2 | 0.05 | 3.15 | 1.20 |
| | Pyridine-2,6-dicarboxylic acid | 42.3 | | | | | | |

*The stability constant measured by the method defined above.

EXAMPLE 11

Samples of photosensitive material B were prepared as in Example 3. Analysis by X-ray fluorometry showed that they contained 5.0 mg of metallic silver and 29.5 mg of metallic copper for 100 $cm^2$. The samples were given an exposure of $10^4$ erg/$cm^2$ by a source of UV radiation (260–420μ) through an optical wedge (optical density of each step: 0.1) in a dry state. The samples were then developed with developers of the composition indicated below that contained the developing agents listed in Table 11 (for the development temperatures and periods, see Table 11), and subsequently fixed in a fixing bath (20° C.) of the same composition as used in Example 9 for 5 minutes. Upon washing with water and drying, a black nonsilver image was formed on each sample.

Developer

| | |
|---|---|
| Developing agent | (see Table 11) |
| L-ascorbic acid | 10 g |
| Sodium metaborate | 35 g |
| Pure water to make | 1,000 ml |

TABLE 11

| Sample No. | Developing agent (g) | | pH of developer | Development temp. (°C.) | Development period (min) | Image quality Dmin | Dmax | γ |
|---|---|---|---|---|---|---|---|---|
| 76 | 4-N—methylaminophenol sulfate | 15 | 10 | 25 | 2 | 0.03 | 3.50 | 1.35 |
| | L-aspartic acid | 33.3 | | | | | | |
| 77 | 4-N—methylaminophenol sulfate | 15 | 10 | 35 | 2 | 0.06 | 3.60 | 1.40 |
| | DL-phenylalanine | 41.3 | | | | | | |
| 78 | 4-N—methylaminophenol sulfate | 10 | 9.5 | 30 | 3 | 0.02 | 3.55 | 1.30 |
| | L-glutamic acid | 36.8 | | | | | | |
| 79 | 4-N—methylaminophenol sulfate | 15 | 10 | 25 | 2 | 0.02 | 3.80 | 1.50 |
| | Glycine | 30 | | | | | | |
| 80 | 4-N—methylaminophenol | 15 | 9.0 | 25 | 3 | 0.10 | 3.40 | 1.20 |

TABLE 11-continued

| Sample No. | Developing agent (g) | | pH of developer | Development temp. (°C.) | Development period (min) | Image quality Dmin | Dmax | γ |
|---|---|---|---|---|---|---|---|---|
| | sulfate | | | | | | | |
| | N—(2-hydroxyethyl)-ethylenediamine (10.11)* | 20.8 | | | | | | |
| 81 | 4-N—methylaminophenol sulfate | 15 | 10.0 | 25 | 4 | 0.07 | 3.50 | 1.30 |
| | N—(carbamoylmethyl)-iminodiacetic acid | 24.9 | | | | | | |

*The stability constant measured by the method defined above.

EXAMPLE 12

Samples of photosensitive material B which were the same as prepared in Example 3 were exposed as in Example 11 and developed with developers of the composition indicated below that contained the developing agents listed in Table 12 (for the development times and temperatures, see Table 12), and subsequently fixed, washed with water and dried as in Example 9.

Developer

| | |
|---|---|
| Developing agent | (see Table 12) |
| L-ascorbic acid | 10 g |
| Sodium metaborate | 30 g |
| Ethylene glycol | 30 g |
| -continued | |
| Pure water to make | 1,000 ml |

TABLE 12

| Sample No. | Developing agent (g) | | pH of developer | Development temp. (°C.) | Development period (min) | Image quality Dmin | Dmax | γ |
|---|---|---|---|---|---|---|---|---|
| 82 | 1-phenyl-3-pyrazolidone | 5 | 9.5 | 25 | 2 | 0.02 | 3.55 | 1.30 |
| | Lysine | 43.8 | | | | | | |
| 83 | 1-phenyl-3-pyrazolidone | 5 | 9.5 | 25 | 2 | 0.03 | 3.40 | 1.35 |
| | L-methionine | 59.8 | | | | | | |
| 84 | 1-phenyl-3-pyrazolidone | 5 | 9.5 | 25 | 3 | 0.08 | 3.60 | 1.25 |
| | Meso-2,3-diamino-butane | 35.2 | | | | | | |
| 85 | 4-methylphenyl-tripyrazolidone | 7 | 10.0 | 25 | 4 | 0.09 | 3.30 | 1.30 |
| | Nitrilotriacetic acid | 38.8 | | | | | | |
| 86 | 4-methylphenyl-tripyrazolidone | 7 | 10.0 | 25 | 4 | 0.08 | 3.45 | 1.20 |
| | N—methyliminodi-acetic acid | 36.8 | | | | | | |

COMPARATIVE EXAMPLE 1

Samples of photosensitive material A which were the same as in Example 1 were immersed for 30 seconds in developers (20° C.) of the compositions indicated in Table 13, and in such a wet state, they were given an exposure of $10^4$ erg/cm$^2$ by a source of UV radiation (260–420μ) through an optical wedge (optical density of each step: 0.1). The samples were developed with developers (25° C.) of the same compositions as used above, and were subsequently fixed, washed with water and dried as in Example 1. The results of sensitometry of the images formed on the processed samples as shown in Table 13.

TABLE 13

| Control No. | Developer | | pH | Development period (min) | Dmin | Dmax | γ |
|---|---|---|---|---|---|---|---|
| 1 | Triethylenetetramine | 0.25 mol | 11.8 | 2.0 | 1.0 | 2.6 | 0.40 |
| | Pure water | 1.0 l | | | | | |
| 2 | L-glutamine | 0.4 mol | 8.2 | 3.0 | 0.03 | 2.4 | 0.70 |
| | Sodium metaborate | 0.026 mol | | | | | |
| | Pure water | 1.0 l | | | | | |
| 3 | L-ascorbic acid | 0.2 mol | 8.2 | 10 | 0.02 | 2.0 | 0.60 |
| | Sodium metaborate | 0.026 mol | | | | | |
| | Pure water | 1.0 l | | | | | |
| 4 | L-ascorbic acid | 0.57 mol | 12.5 | 10 | 0.02 | 0.8 | 0.05 |
| | Di-ethanolamine | 0.48 mol | | | | | |

TABLE 13-continued

| Control No. | Developer | | pH | Development period (min) | Dmin | Dmax | γ |
|---|---|---|---|---|---|---|---|
| | (16.40)* | | | | | | |
| | Sodium hydroxide | 2.5 mol | | | | | |
| | Pure water | 1.0 l | | | | | |
| 5 | 4-N—methylamino-phenol sulfate | 0.086 mol | 8.2 | 10 | 0.02 | 0.6 | 0.05 |
| | Sodium sulfite | 0.080 mol | | | | | |
| | Sodium metaborate | 0.026 mol | | | | | |
| | Pure water | 1.0 l | | | | | |

*The stability constant measured by the method defined above.

COMPARATIVE EXAMPLE 2

Samples of photosensitive material B which were the same as prepared in Example 3 were given an exposure of $10^4$ erg/cm$^2$ by a source of UV radiation (260–420μ) in a dry state through an optical wedge (optical density of each step: 0.1). Then, the samples were developed with developers (25° C.) of the compositions and pHs indicated in Table 14 (for the development duration, see Table 14), and subsequently fixed, washed with water and dried as in Example 1. The results of sensitometry of the images formed on the processed samples are listed in Table 14.

TABLE 14

| Control No. | Developer | | pH | Development period (min) | Dmin | Dmax | γ |
|---|---|---|---|---|---|---|---|
| 6 | Triethylenetetramine | 0.25 mol | 11.8 | 2.0 | 1.2 | 2.8 | 0.35 |
| | Pure water | 1.0 l | | | | | |
| 7 | 4-N—methylaminophenol hemisulfate | 0.03 mol | 8.2 | 10 | 0.02 | 0.8 | 0.05 |
| | Sodium sulfite | 0.08 mol | | | | | |
| | Sodium metaborate | 0.025 mol | | | | | |
| | Pure water | 1.0 l | | | | | |
| 8 | Araboascorbic acid | 0.2 mol | 8.2 | 10 | 0.03 | 1.8 | 0.70 |
| | Sodium metaborate | 0.025 mol | | | | | |
| | Pure water | 1.0 l | | | | | |
| 9 | L-ascorbic acid | 0.57 mol | 12.5 | 10 | 0.02 | 0.7 | 0.06 |
| | Diethanolamine | 0.48 mol | | | | | |
| | (16.40)* | | | | | | |
| | Sodium hydroxide | 2.5 mol | | | | | |
| | Pure water | 1.0 l | | | | | |

*The stability constant measured by the method defined above.

Evaluation

As Table 1 shows, developer samples Nos. 1 to 6 of the present invention performed better than the control samples in development of copper (I) halide photosensitive materials after exposure in a wet state; they produced images that had a lower fog density, a higher maximum color density and a harder tone than those produced with the control samples. Table 2 demonstrates that the same results were obtained with samples Nos. 7 to 14 of the present invention.

One can see from Tables 3, 4 and 5 that developer samples Nos. 15 to 35 also performed better than the control samples in development of copper (I) halide photosensitive materials after exposure in a dry state; they produced images that had a lower fog density, a higher maximum color density and a harder tone than those produced with the control samples.

Tables 6, 9 and 10 show that developer samples Nos. 36 to 40, and 49 to 75 performed better than the control samples in development of copper (I) halide photosensitive materials after exposure in a wet state; they produced images that had a lower fog density, a higher maximum color density and a harder tone than those produced with the control samples. Tables 7, 8, 11 and 12 show that developer sample Nos. 41 to 48 and 76 to 86 produced the same results in development after exposure in a dry state.

What is claimed is:

1. An image-forming method wherein a photosensitive material comprising a support having a photosensitive copper (I) halide emulsion that optionally contains silver halide and which has grains of the copper (I) halide crystal dispersed in a binder is subjected to imagewise exposure and development with an alkaline solution containing at least one compound selected from each of at least two of the following three groups: (A) a group consisting of α-amino acids, α-amino acid derivatives, aliphatic carboxylic acids, oxycarboxylic acids, ketocarboxylic acids, aromatic carboxylic acids, aminocarboxylic acids, quinoline derivatives, pyridine derivatives, amines and amine derivatives, which amines and amine derivatives form a Cu(II) complex having a stability constant between 5 and 15; (B) a group consisting of 4-aminophenols and 3-pyrazolidones; and (C) a group consisting of ascorbic acid derivatives of the following formula (I) and alkali metal salts thereof:

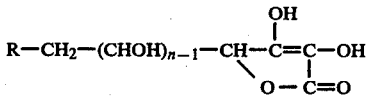

(I)

wherein R is a hydrogen atom or a hydroxyl group, and n is a positive integer of from 1 to 4; provided that when n=1, R represents only a hydroxyl group.

2. A method according to claim 1, wherein the developer is an alkaline solution containing at least one compound selected from the group (A) and at least one compound selected from the group (C).

3. A method according to claim 1, wherein the developer is an alkaline solution containing at least one compound selected from the group (B) and at least one compound selected from the group (C).

4. A method according to claim 1, wherein the developer is an alkaline solution containing at least one compound selected from the group (A) and at least one compound selected from the group (B).

5. A method according to claim 1, wherein the compounds selected from the group (A) except said amines and amine derivatives form a Cu(II) complex with $C^{2+}$, said complex having a stability constant between 5 and 15.

6. A method according to claim 1, wherein the group (A) consists of malonic acid, citric acid, oxalacetic acid, salicylic acid, 5-sulfosalicylic acid, ethylenediamine, N-methyl-ethylenediamine, N-ethyl-ethylenediamine, N-n-propylethylenediamine, N-isopropylethylenediamine, N-(2-hydroxyethyl)ethylenediamine, N,N-dimethylethylenediamine, N,N-diethylethylenediamine, N,N'-dimethylethylenediamine, N,N'-diethylethylenediamine, N,N'-di-n-propylethylenediamine, N,N'-di(2-hydroxyethyl)ethylenediamine, N,N,N'N'-tetramethylethylenediamine, 1,2-diaminopropane, meso-2,3-diaminobutane, rac-2,3-diaminobutane, trimethylenediamine, cis-1,2-diaminocyclohexane, trans-1,2-diaminocyclohexane, trans-1,2-diaminocycloheptane, 1,2,3-triaminopropane, 1,3-diamino-2-aminomethylpropane, 3,3'-diaminodipropylamine, di(2-aminoethyl) ether, 2-aminomethylpyridine, pyridine-2-carboxylic acid, pyridine-2,3-carbocyclic acid, nicotinic acid hydrazide, isonicotinic acid hydrazide, pyridoxamine, piperidine-2,6-dicarboxylic acid, histamine, 3-methylhistamine, iminodiacetic acid, imidodipropionic acid, N-methyliminodiacetic acid, N-(3,3-dimethylbutyl-)iminodiacetic acid, phenyliminodiacetic acid, hydroxyethyliminodiacetic acid, hydroxyethyliminodipropionic acid, hydroxypropyliminodiacetic acid, 2-hydroxycyclohexyliminodiacetic acid, methoxyethyliminodiacetic acid, N-(carbamoylmethyl)iminodiacetic acid, 2-ethoxycarbonylaminoethyliminodiacetic acid, nitrilotriacetic acid, carboxyethyliminodiacetic acid, carboxymethyliminodipropionic acid, N-n-butylethylenediaminetriacetic acid, N-cyclohexylethylenediaminetriacetic acid, glycine, sarcosine, alanine, β-alanine, valine, norleucine, leucine, phenylalanine, tyrosine, serine, phosphoserine, threonine, methionine, aspartic acid, asparagine, glutamic acid, ornithine, lysine, arginine, proline, hydroxyproline, histidine, tryptophane, N-ethylglycine, N-n-propylglycine, N-isopropylglycine, N,N-dimethylglycine, N,N-diethylglycine, N,N-bis(2-hydroxyethyl)glycine, N,N-bis(2-hydroxypropyl)glycine, 1-aminocyclopentanecarboxylic acid, 1-aminocyclohexanecarboxylic acid, 1-aminocycloheptanecarboxylic acid, glycylglycine, glycylsarcosine, glycylleucine, glycyltyrosine, glycylproline, sarcosylglycine, β-alanylhistidine, lysine vasopressin, sodium glutamate acid, oxine-5-sulfonic acid, quinoline-2-carboxylic acid, quinoline-8-carboxylic acid, 4-hydroxy-1,5-naphthylridine, 8-hydroxy-1,6-naphthyridine and 8-hydroxy-1,7-naphthyridine.

7. A method according to claim 1, wherein the group (B) consists of 4-N-methylaminophenol sulfate, 4-N-benzylaminophenol hydrochloride, 4-N,N-diethylaminophenol hydrochloride, 4-aminophenol sulfate, 1-oxymethyl-4-aminophenol hydrochloride, 2,4-diaminophenol, 4-N-carboxymethylaminophenol-P-oxyphenylglycine, 4-phenyl-3-pyrazolidone, 4,4-dimethyl-1-phenyl-3-pyrazolidone and 4-methyl-phenyl-3-pyrazolidone.

8. A method according to claim 1, wherein the group (C) consists of L-ascorbic acid, araboascorbic acid, 1-erythroascorbic acid and α-glycoascorbic acid, and L-ascorbic acid and alkali metal salts thereof.

9. A method according to claim 2, wherein said alkaline solution contains a compound selected from said group (A) in an amount of 0.01–2.0 mol/liter and a compound selected from said group (C) in an amount of 0.05–1.0 mol/liter.

10. A method according to claim 3, wherein said alkaline solution contains a compound selected from said group (B) in an amount of 0.01–2.0 mol/liter and a compound selected from said group (C) in an amount of 0.05–1.0 mol/liter.

11. A method according to claim 4, wherein said alkaline solution contains a compound selected from said group (A) in an amount of 0.01–2.0 mol/liter and 4-aminophenols in an amount of 0.05–0.5 mol/liter or 3-pyrazolidones in an amount of 0.01–0.2 mol/liter.

12. A method according to claim 1, wherein the pH value of said alkaline solution is between 7 and 14.

* * * * *